US007491883B2

(12) United States Patent
Lee et al.

(10) Patent No.: US 7,491,883 B2
(45) Date of Patent: Feb. 17, 2009

(54) COAXIAL CABLE

(75) Inventors: Hsi-Fu Lee, Taipei Hsien (TW); Liang Liu, Beijing (CN); Kai-Li Jiang, Beijing (CN); Caesar Chen, Santa Clara, CA (US); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/860,504

(22) Filed: Sep. 24, 2007

(65) Prior Publication Data

US 2008/0254675 A1 Oct. 16, 2008

(30) Foreign Application Priority Data

Apr. 11, 2007 (CN) ..... 2007 1 0073891

(51) Int. Cl.
*H01B 7/00* (2006.01)

(52) U.S. Cl. ..... 174/28

(58) Field of Classification Search ..... 174/28, 174/102 R, 106 R, 108, 102 SC, 106 SC
See application file for complete search history.

(56) References Cited

U.S. PATENT DOCUMENTS

| | | | | |
|---|---|---|---|---|
| 7,045,716 | B2 * | 5/2006 | Granheim | 174/102 SC |
| 2004/0020681 | A1 * | 2/2004 | Hjortstam et al. | 174/102 SC |
| 2005/0170177 | A1 * | 8/2005 | Crawford et al. | 428/375 |

* cited by examiner

*Primary Examiner*—William H Mayo, III
(74) *Attorney, Agent, or Firm*—D. Austin Bonderer

(57) ABSTRACT

A coaxial cable (10) includes at least one conducting wire (110), at least one insulating layer (120) coating a respective conducting wire (110), at least one shielding layer (130) surrounding the at least one insulating layer (120), and a single sheath (140) wrapping the at least one shielding layer (130). The shielding layer (130) includes a metal layer and a carbon nanotube film.

20 Claims, 4 Drawing Sheets

COAXIAL CABLE

RELATED APPLICATIONS

This application is related to commonly-assigned, application: U.S. patent application Ser. No. 11/564,266, entitled, "COAXIAL CABLE", filed Nov. 28, 2006; now U.S. Pat. No. 7,413,474, U.S. patent application Ser. No. 11/860,501, entitled "COAXIAL CABLE", filed Sep. 24, 2007, which is pending; and U.S. patent application Ser. No. 11/860,503, entitled "COAXIAL CABLE", filed Sep. 24, 2007, which is also pending. The disclosures of the above-identified applications are respectively incorporated herein by reference.

BACKGROUND

1. Field of the Invention

The present invention relates to cables and, particularly, to a coaxial cable.

2. Discussion of Related Art

A coaxial cable is an electrical cable including an inner conductor, an insulating layer, and a conducting layer, usually surrounded by a sheath. The inner conductor can be, e.g., a solid or braided wire, and the conducting layer can, for example, be a wound foil, a woven tape, or a braid. The coaxial cable requires an internal insulating layer (i.e., a dielectric) to act as a physical support and to maintain a constant spacing between the inner conductor and the conducting layer, in addition to electrically isolating the two.

The coaxial cable may be rigid or flexible. Typically, the rigid type has a solid inner conductor, while the flexible type has a braided inner conductor. The conductors for both types are usually made of thin copper wires. The insulating layer, also called the dielectric, has a significant effect on the cable's properties, such as its characteristic impedance and its attenuation. The dielectric may be solid or perforated with air spaces. The shielding layer is configured for ensuring that a signal to be transmitted stays inside the cable and that all other signals to stay out (i.e., acts as a two-way signal shield). The shielding layer also serves as a secondary conductor or ground wire.

The coaxial cable is generally applied as a high-frequency transmission line to carry a high frequency or broadband signal. Sometimes, DC power (called a bias) is added to the signal to supply the equipment at the other end, as in direct broadcast satellite receivers, with operating power. The electromagnetic field carrying the signal exists (ideally) only in the space between the inner conductor and conducting layer, so the coaxial cable cannot interfere with and/or suffer interference from external electromagnetic fields.

However, the conventional coaxial cable is low in yield and high in cost. Therefore, a coaxial cable that has great shield effectiveness and that is suitable for low-cost mass production is desired.

SUMMARY OF THE INVENTION

Accordingly, a coaxial cable that has great shield effectiveness and is suitable for low-cost mass production is provided in the present cable. The coaxial cable includes at least one conducting wire: at least one insulating layer, each insulating layer being respectively coated on a corresponding conducting wire; at least one shielding layer surrounding the insulating layer; and a sheath. The shielding layer includes a metal layer and a carbon nanotube film.

In one present embodiment, a coaxial cable is provided that includes a conducting wire, an insulating layer applied on the conducting wire, a shielding layer deposited on the insulating layer, and a sheath coating the shielding layer.

In another present embodiment, a coaxial cable is provided that includes a number of conducting wires, a number of insulating layers respectively applied on the corresponding conducting wires, a shielding layer surrounding all the conducting wires coated with a corresponding insulating layer, and a sheath coating the shielding layer.

In another present embodiment, a coaxial cable is provided that includes a number of conducting wires, a number of insulating layers respectively supplied on the corresponding conducting wires, a number of shielding layers respectively coating the corresponding insulating layers, and a sheath, in turn, surrounding all the conducting wires, each coated with a corresponding combination of an insulating layer and a shielding layer.

BRIEF DESCRIPTION OF THE DRAWINGS

Many aspects of the present coaxial cable can be better understood with reference to the following drawings. The components in the drawings are not necessarily to scale, the emphasis instead being placed upon clearly illustrating the present coaxial cable.

DETAILED DESCRIPTION OF PREFERRED EMBODIMENTS

The present coaxial cable is further described below with reference to the drawings.

The present coaxial cable includes at least one conducting wire, at least one insulating layer, each insulating layer respectively surrounding a corresponding conducting wire, at least one shielding layer encompassing the at least one insulating layer, and a sheath wrapping the above-mentioned three parts thereof. The coaxial cable is, usefully, an electromagnetic interference (EMI) shield cable.

Figure 1:
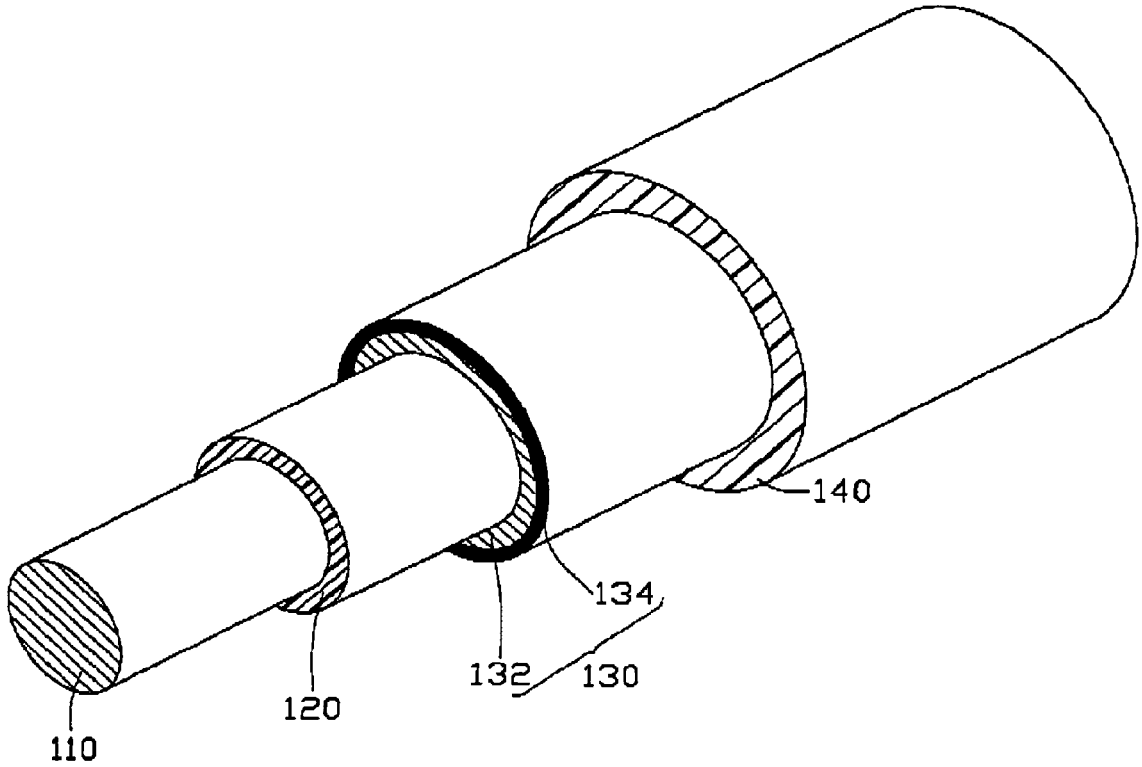
FIG. 1 is a perspective view of a coaxial cable of the first embodiment.
Figure 2:
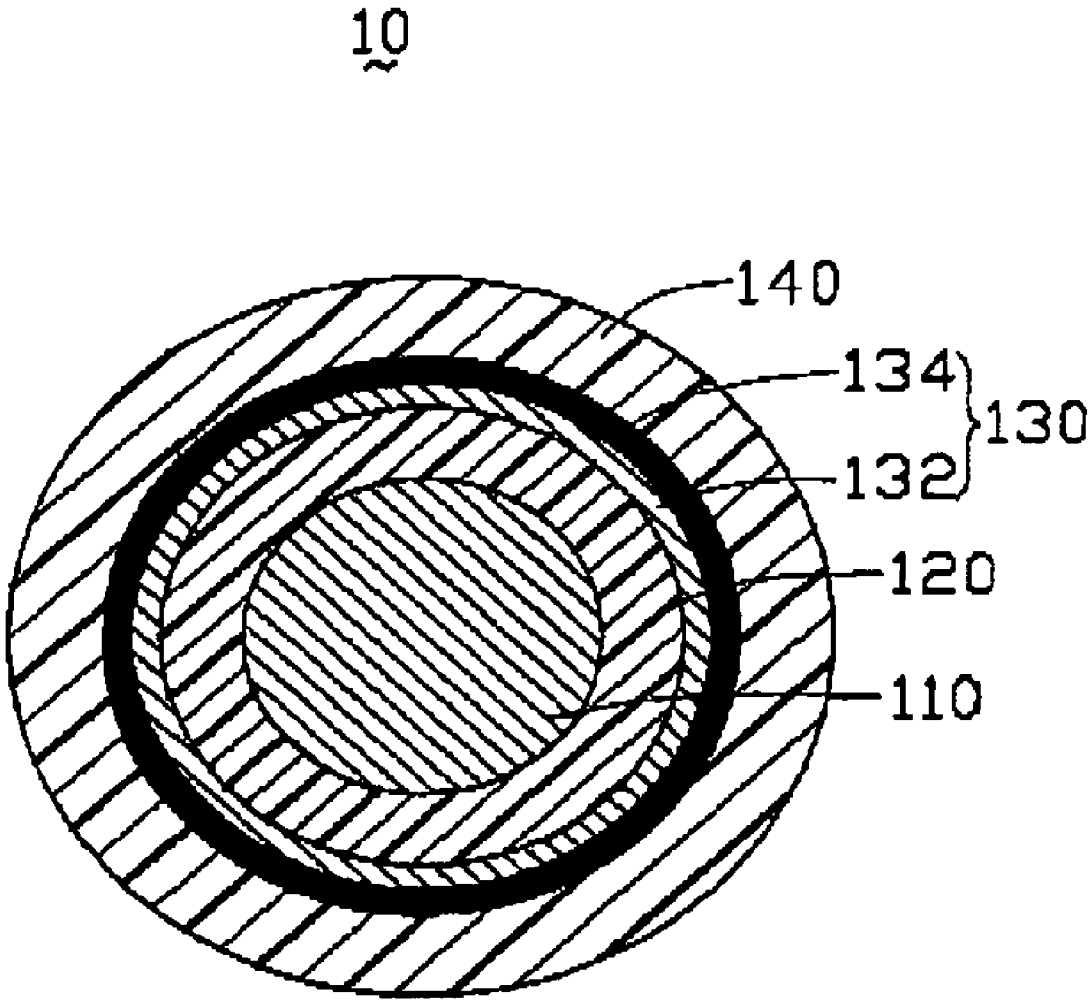
FIG. 2 is a plane, cross-sectional view along the II-II direction of the coaxial cable in FIG. 1.

Referring to FIGS. 1 and 2, a coaxial cable 10, according to the first embodiment, is shown. The coaxial cable 10 includes a conducting wire 110, an insulating layer 120, a shielding layer 130 and a sheath 140. The axis of the conducting wire 110, the insulating layer 120, the shielding layer 130, and the sheath 140 is consistent (i.e., such elements are coaxial), and the arrangement thereof is, in turn, from center/inner to outer.

The conducting wire 110 can be a single wire or a number of stranded wires. The conducting wire 110 is made of a conducting material, such as a metal, an alloy, a carbon nanotube, or a carbon nanotube composite having electrical conduction. Advantageous metals for this purpose are aluminum (Al) or copper (Cu). A particularly useful alloy is a copper-zinc alloy or a copper-silver alloy, wherein a mass percent of copper in the copper-zinc alloy is about 70% and that in the copper-silver alloy is about 10-40%. The carbon nanotube composite advantageously includes the carbon nanotubes and one of the above-mentioned alloys. Beneficially, the mass percent of the carbon nanotubes in the carbon nanotube composite is about 0.2%-10%. The carbon nanotube is, usefully, a sort/form of a carbon nanotube chain connected by van der Waals attractive forces between ends of adjacent carbon nanotubes.

The insulating layer 120 coating/surrounding the conducting wire 110 is an electric insulator/dielectric and can be, for example, polytetrafluoroethylene (PTFE) or a nano-sized clay/polymer composite. The clay of the composite is a hydrated alumino-silicate mineral in a nano-sized layer form. The mineral can, for example, be nano-sized kaolinite or nano-sized montmorillonite. The polymer of the clay/polymer composite is, usefully, chosen from the group consisting a material of silicone, polyamide, and polyolefin, such as polyethylene and polypropylene. In one appropriate embodiment, the clay/polymer composite includes nano-sized montmorillonite and polyethylene. The clay/polymer composite has many good properties, such as electrically insulating, fire resistant, low smoke potential, and halogen-free. The clay/polymer is an environmentally friendly material and can be applied as an electrically insulating material to protect the conducting wire and to keep/maintain a certain space between the conducting wire and the shielding layer.

Referring to FIG 2, the shielding layer 130 coating/encompassing the insulating layer 120 includes a metal layer 132 and a carbon nanotube film 134. The metal layer 132 is deposited on the insulating layer 120, and the carbon nanotube film 134 coats the metal layer 132; or the carbon nanotube film 134 is deposited on the insulating layer 120, and the metal layer 132 coats the carbon nanotube film 134. The metal layer 132 is, e.g., a metal film, a wound foil, a woven tape, or a braid.

The carbon nanotube film 134 may cover directly or/and wrap the insulating layer 120 by the van der Waals attractive force. The carbon nanotube film 134 is in an ordered form or in a disordered firm. A width of the carbon nanotube film 134 is, approximately, on the order from tens of nanometers to several microns.

The ordered carbon nanotube film can be a monolayer structure or a multilayer structure. The multilayer carbon nanotube film includes a number of clearances between the carbon nanotubes of the carbon nanotube films. The more the number of the carbon nanotube films that is employed, the smaller clearances.

A method for making the ordered carbon nanotube film includes the steps of: (1) providing a carbon nanotube array; (2) drawing out a first carbon nanotube film from the carbon nanotube array; (3) adhering the first carbon nanotube film on a fixed frame, and removing the part of the first carbon nanotube film on an outside thereof; (4) repeating the step (2) and (3), then adhering a second carbon nanotube film above/upon the first carbon nanotube film adhered on the fixed frame; and (5) treating the above carbon nanotube films with an organic solvent.

In the step (1), the carbon nanotube array is generally a super-aligned carbon nanotube array (Nature 2002, 419, 801). The carbon nanotube array can be manufactured using a chemical vapor deposition method. The method includes the steps of: (a) providing a substantially flat and smooth substrate, with the substrate being, e.g., a p-type or n-type silicon wafer; (b) depositing a catalyst on the substrate, the catalyst being usefully selected from the group consisting of iron, cobalt, nickel, or alloys of the same; (c) annealing the substrate with the catalyst in protective gas at 300~400° C. for about 10 hours; and (d) heating the annealed substrate with the catalyst to 500~700° C., supplying a mixture of carbon-containing gas and protective gas, controlling a difference between the local temperature of the catalyst and the environmental temperature to be at least 50° C., controlling a partial pressure of the carbon containing gas to be less than 0.2, and growing a number of carbon nanotubes on the substrate after 5~30 minutes, such that the carbon nanotube array is formed on the substrate. The carbon-containing gas can, opportunely, be a hydrocarbon such as acetylene, ethane, etc. The protective gas can, beneficially, be an inert gas, nitrogen gas, or a mixture thereof.

The superficial density of the carbon nanotube array manufactured by above-described process with the carbon nanotubes being compactly bundled up together is higher. The van der Waals attractive force between adjacent carbon nanotubes is strong, and diameters of the carbon nanotubes are correspondingly substantial.

In the step (2), the first carbon nanotube film may be drawn out from the carbon nanotube array with a tool with a certain width, such as an adhesive tape. Specifically, the initial carbon nanotubes of the carbon nanotube array can be drawn out with the adhesive tape. As the carbon nanotubes are drawn out, the other carbon nanotubes are also drawn out due to the van der Waals attractive force between ends of adjacent carbon nanotubes, and then the first carbon nanotube film is formed. The carbon nanotubes in the first carbon nanotube film are substantially parallel to each other. The carbon nanotube film may, for example, have a length of several centimeters and a thickness of several microns.

In the step (3), the fixed frame advantageously is quadrate and made of a metal or any other suitable structural material. The first carbon nanotube film has a favoarable surface tension/good wetting and, thus, can firmly attach to the fixed frame. The part of the first carbon nanotube film extending out of the fixed frame can be removed by a mechanical force, such as scraping with a knife.

In the step (4), a second carbon nanotube film is drawn from the carbon nanotube array, as in the step (2). The second carbon nanotube film is adhered on the first carbon nanotube film and the fixed frame, as in the step (3). The first carbon nanotube film together with the second carbon nanotube film forms a stable two-layer film structure because of the van der Waals attractive force therebetween. A discernable inclination (i.e., an exact 0° angle is not intended) between the carbon nanotubes of the first carbon nanotube film and that of the second carbon nanotube film is in an approximate range from 0° to 90°, quite usefully about 90° (e.g., at least within about ±5°). Still advantageously, a discernable inclination, in which an exact 0° angle is not included, is at least defined.

Further, the step (4) can be repeated in order to get a multilayer carbon nanotube film structure.

In the step (5), the carbon nanotube film is treated with an organic solvent by dripping the organic solvent thereon or by soaking the fixed frame in a vessel filled with the organic solvent. After this treatment, the parallel carbon nanotubes of the carbon nanotube film shrink into a number of the carbon nanotube yarns. The organic solvent is a volatilizable organic solvent, such as ethanol, methanol, acetone, dichloroethane, or chloroform.

The disordered carbon nanotube film, on the other hand, is a condensate self-assembly film. The method for making the disordered carbon nanotube film includes the steps of: (1) preparing a suspension of carbon nanotubes and an organic solvent; and (2) dripping the suspension on a liquid and forming a disordered carbon nanotube film.

In the step (1), an organic solvent, such as ethanol, acetone, methanol, isopropanol, and/or ethyl acetate, is infiltrated to the carbon nanotubes. The carbon nanotubes may be single-walled carbon nanotubes, double-walled carbon nanotubes, or multi-walled carbon nanotubes. A beneficial length of the carbon nanotubes is in an approximate range from microns to tens of microns. The step (1) includes the sub-steps, as following: putting a certain number of carbon nanotubes into the organic solvent and then getting a mixture; and (2) treating the mixture by ultrasonic dispersion for at least 5 minutes and getting a suspension with the carbon nanotubes uniformly dispersed therein.

In step (2), the liquid is non-infiltrative to the carbon nanotubes and, rather suitably, is pure water or a salt solution. The width of the discorded carbon nanotube film is determined by a mass percent of the carbon nanotubes of the suspension. For example, the width of the discorded carbon nanotube film is tens of nanometers when the mass percent of the carbon nanotubes is about 0.1%-1%, and the width of the discorded carbon nanotube film is hundreds to thousands of nanometers when the mass percent of the carbon nanotubes is about 1%-10%.

The material of the sheath 140 is, advantageously, the same as the material used for the insulating layer 120. This kind of material has many good properties, such as good mechanical behavior, electrically insulating, fire resistant, chemically durable, low smoke potential, and halogen-free. Thus, the material is an environmentally friendly material and can be applied to protect the coaxial cable 10 from external injury, such as physical, chemical, and/or mechanical injury.

Figure 3:
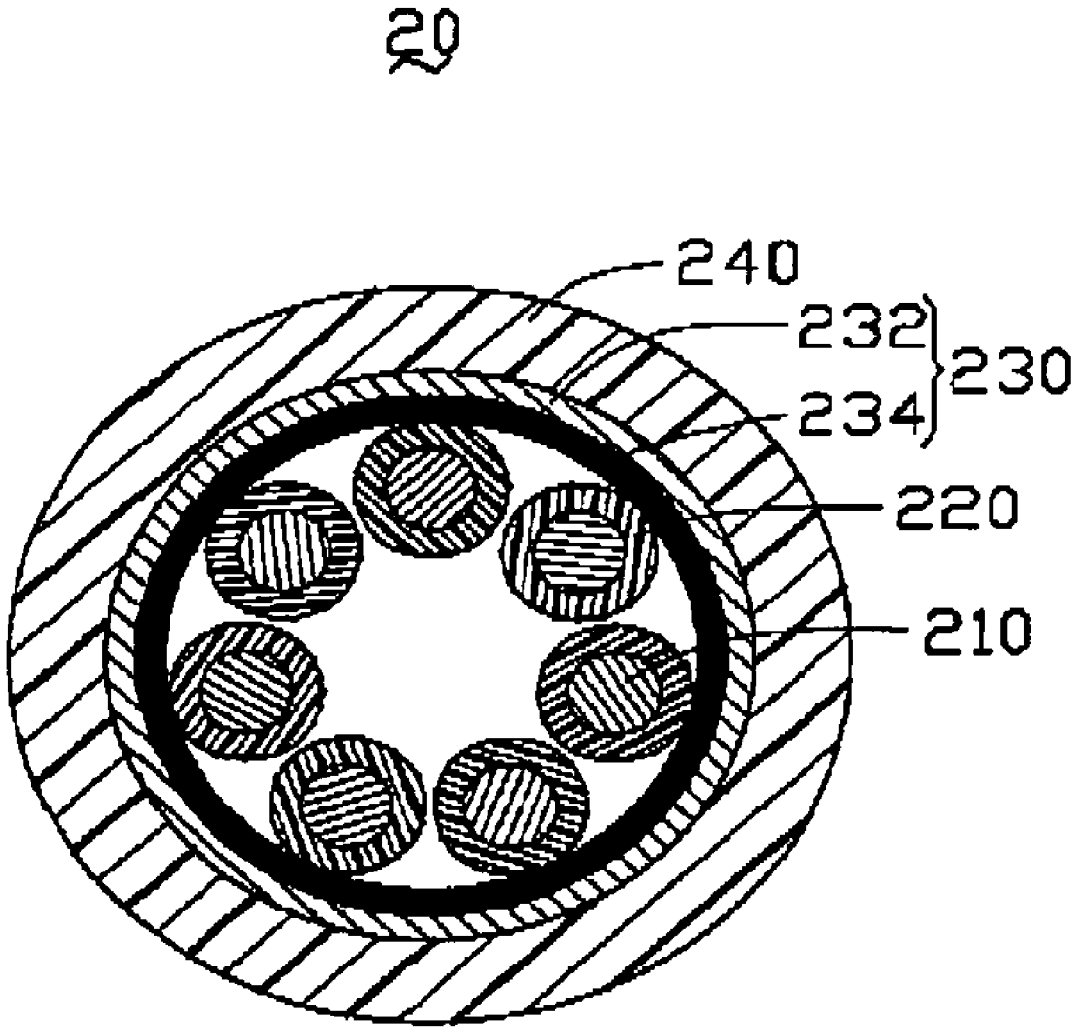
FIG. 3 is a plane, cross-sectional view of a coaxial cable of the second embodiment.

Referring to FIG. 3, a coaxial cable 20, according to the second embodiment is shown. The coaxial cable 20 includes a number of conducting wires 210; a number of insulating layers 220 each, respectively, surrounding a corresponding one of the conducting wires 210; a single shielding layer 230 surrounding all the conducting wires 210 with the corresponding insulating layer 220 coated thereon; and a single sheath 240 wrapping the shielding layer 230. The materials of the conducting wires 210, the insulating layer 220, the shielding layer 230, and the sheath 240 are substantially similar to the materials of the corresponding parts in the first embodiment.

Figure 4:
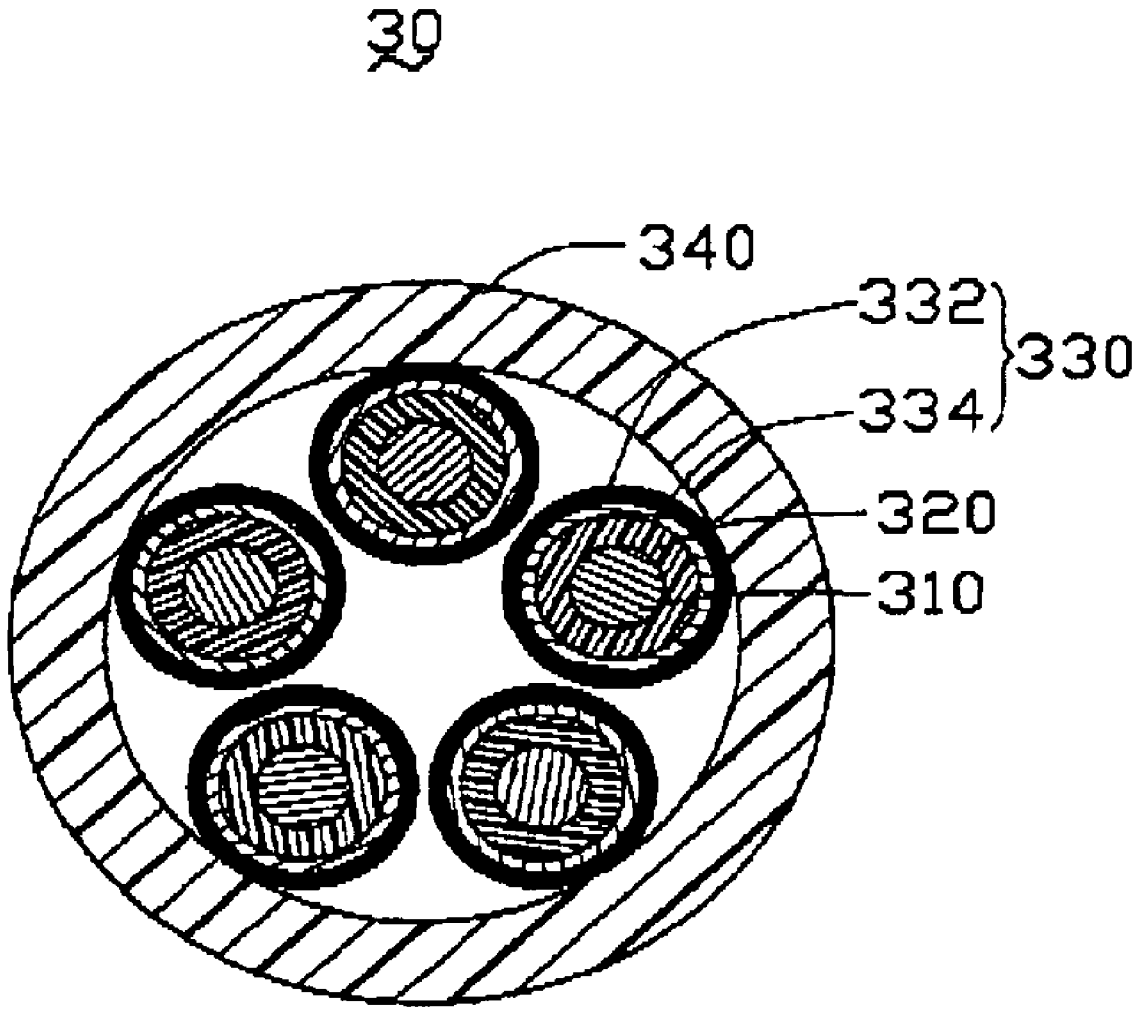
FIG. 4 is a plane, cross-sectional view of a coaxial cable of the third embodiment.

Referring to FIG 4, a coaxial cable 30, according to the third embodiment, is shown. The coaxial cable 30 includes a number of conducting wires 310; a number of insulating layers 320 respectively coating a corresponding one of the conducting wires 310; a number of shielding layers 330 respectively applied to a corresponding one of the insulating layers 320; and a single sheath 340 wrapping all the conducting wires 310, with each conducting wire being separately coated, in turn, with a corresponding insulating layer 320 and a corresponding shielding layer 330. The materials of the conducting wires 310, the insulating layers 320, the shielding layers 330, and the sheath 340 are substantially similar to the materials of the corresponding parts in the first embodiment. The arrangement of the respective shielding layers 330 each surrounding a corresponding one of the conducting wires 310 can provide quite good shielding against noises (i.e., electrical interference) from outside and between the conducting wires 310, which ensures the stable characteristics of the coaxial cable 30.

Finally, it is to be understood that the embodiments mentioned above are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A coaxial cable comprising:

at least one conducting wire;

at least one insulating layer, each insulating layer being respectively coated on a corresponding conducting wire;

at least one shielding layer surrounding the at least one insulating layer, each shielding layer comprising a metal layer and one or more carbon nanotube films; and a sheath wrapping the at least one shielding layer.

2. The coaxial cable as claimed in claim 1, wherein the metal layer of the shielding layer is deposited on the insulating layer, and the one or more carbon nanotube films of the shielding layer coats the metal layer thereof.

3. The coaxial cable as claimed in claim 1, wherein the one or more carbon nanotube films of the shielding layer is deposited on the insulating layer, and the metal layer of the shielding layer coats the one or more carbon nanotube films thereof.

4. The coaxial cable as claimed in claim 1, wherein the coaxial cable comprises a conducting wire, an insulating layer applied directly upon the conducting wire, a shielding layer coated upon the insulating layer, and a sheath wrapping the shielding layer.

5. The coaxial cable as claimed in claim 1, wherein the coaxial cable comprises a plurality of conducting wires, a plurality of insulating layers each respectively coated on a corresponding one of the conducting wires, a shielding layer surrounding all the coated conducting wires, and a sheath wrapping the shielding layer.

6. The coaxial cable as claimed in claim 1, wherein the coaxial cable comprises a plurality of conducting wires, a plurality of insulating layers respectively coated on a corresponding one of the conducting wires, a plurality of shielding layers respectively coated on a corresponding one of the insulating layers, and a sheath wrapping all the conducting wires being coated by the insulating layers and the shielding layers, in turn, with the corresponding insulating layer and the corresponding shielding layer.

7. The coaxial cable as claimed in claim 1, wherein the carbon nanotube film is either in an ordered form or in a disordered form.

8. The coaxial cable as claimed in claim 7, wherein the carbon nanotube film is in a disordered form, the disordered form being a self-assembly film.

9. The coaxial cable as claimed in claim 1, wherein each of the carbon nanotube films comprises of carbon nanotubes substantially aligned in the same direction, and the one or more carbon nanotube films form either a monolayer film or a multilayer film.

10. The coaxial cable as claimed in claim 9, wherein the carbon nanotubes of the same layer are substantially aligned in the same direction.

11. The coaxial cable as claimed in claim 9, wherein the carbon nanotubes in the adjacent layers of the ordered carbon nanotube film are aligned at an angle that is in an approximate range above 0° up to and including 90°.

12. The coaxial cable as claimed in claim 1, wherein the carbon nanotube film either covers the insulating layer directly or wraps the insulating layer.

13. The coaxial cable as claimed in claim 1, wherein a width of the shielding layer is in an approximate range from tens of nanometers to several microns.

14. The coaxial cable as claimed in claim 1, wherein the shielding layers comprise of at least fifty percent carbon nanotubes.

15. The coaxial cable as claimed in claim 1, wherein the shielding layers comprise of at least seventy-five percent carbon nanotubes.

16. A coaxial cable comprising

N conducting wires;

N insulating layers; and

M shielding layers;

wherein each conducting wire is insulated by an insulating layer; the shielding layers comprise a metal layer and one or more carbon nanotube films; N is a positive integer greater than zero; and M is a positive integer greater than zero.

17. The coaxial cable as claimed in claim 16, wherein N is equal to one, and M is equal to one, and a shielding layer located adjacent to the insulating layer.

18. The coaxial cable as claimed in claim 16, wherein each of the carbon nanotube films comprises of carbon nanotubes substantially aligned in the same direction, and the one or more carbon nanotube films form either a monolayer film or a multilayer film.

19. The coaxial cable as claimed in claim 18, wherein the carbon nanotubes of the same layer carbon nanotube film are substantially aligned in the same direction.

20. The coaxial cable as claimed in claim 18, wherein the carbon nanotubes in the adjacent layers of the carbon nanotube film are aligned at an angle that is in an approximate range above 0° up to and including 90°.

* * * * *